United States Patent [19]

Bilawa et al.

[11] Patent Number: 4,846,666

[45] Date of Patent: Jul. 11, 1989

[54] METHOD AND BURNER FOR BURNING FUEL

[75] Inventors: Hans Bilawa, Beckum; Eberhard Neumann, Ennigerloh, both of Fed. Rep. of Germany

[73] Assignee: Krupp Polysius AG, Beckum, Fed. Rep. of Germany

[21] Appl. No.: 187,047

[22] Filed: Apr. 27, 1988

[30] Foreign Application Priority Data

May 8, 1987 [DE] Fed. Rep. of Germany ..... 3715453

[51] Int. Cl.[4] ..... F23C 7/00; F23Q 9/00; F23M 9/00

[52] U.S. Cl. ..... 431/8; 431/187; 431/284; 431/182

[58] Field of Search ..... 431/8, 187, 182, 284, 431/181; 239/403, 424; 110/261, 263

[56] References Cited

U.S. PATENT DOCUMENTS

| | | | |
|---|---|---|---|
| 4,428,727 | 1/1984 | Deussner et al. | 431/187 |
| 4,453,913 | 6/1984 | Gitman | 431/8 |
| 4,474,120 | 10/1984 | Adrian et al. | 110/261 |
| 4,614,159 | 9/1986 | Sugiura et al. | 431/187 |
| 4,626,195 | 12/1986 | Sato et al. | 431/284 |
| 4,702,180 | 10/1987 | Kiga | 110/263 |

*Primary Examiner*—Albert J. Makay
*Assistant Examiner*—Denise L. Ferensic
*Attorney, Agent, or Firm*—Learman & McCulloch

[57] ABSTRACT

The invention relates to a method and a burner in which a proportion of the fuel is delivered via an outer annular duct and accelerated at the outlet end to a high speed, while a further proportion of the fuel is delivered via a second, inner annular duct and retarded at the outlet end to a slow speed. This results in stabilization and regulation of the principal flame by a permanent pilot flame.

14 Claims, 1 Drawing Sheet

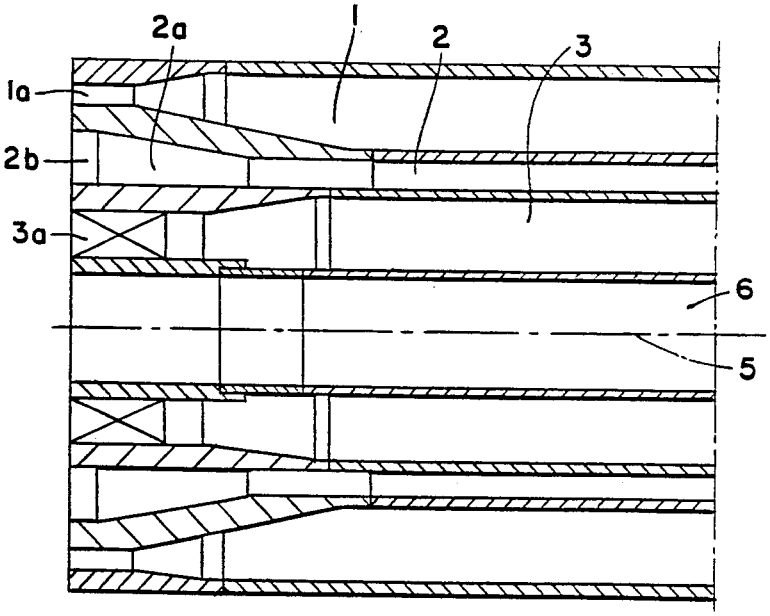
2a
1
2
3
1a
2b
3a
6
5

METHOD AND BURNER FOR BURNING FUEL

The invention relates to a method and to a burner for burning solid, liquid or gaseous fuel, particularly for rotary kilns.

Methods and burners of this type are known for example from DE-A-29 05 746 and 30 27 587.

BACKGROUND OF THE INVENTION

Since in rotary kilns the greater proportion of the heat energy has to be transmitted to the material to be treated by radiation, great demands are made on the temperature profile produced by the burner in the direction of the longitudinal axis of the kiln. This is aggravated by the fact that for reasons of heat economy the highest possible proportion of the combustion air should be delivered to the kiln system in the form of preheated secondary air from the cooling of the burnt material. Generally speaking this secondary air cannot be delivered via the burner.

The previously known burners for rotary kilns are therefore designed in such a way that the fuel is mixed together with the secondary air with the aid of the smallest possible proportion of primary air, which is usually taken from the ambient air. In order to stablise the flame an internal reverse flow is usually produced with the aid of swirlers or blockers.

In these known constructions rotating or diverging motions of a certain intensity are forced upon the free jets consisting of fuel and air and govern the intermixing with the secondary air. Without exception, flames produced in this way have the disadvantage that depending upon the intensity of the rotation or divergence a more or less large proportion of the fuel is thrown out of the actual flame and burnt in the secondary air stream, which results in a lowering of the density of energy of the flame or an increase in the specific volume of the flame.

In the previously known constructions strict limits are set on the production of short flames, since the intensification of rotation or divergence which this requires brings with it of necessity an increase in the internal reverse flow. This internal reverse flow takes up a certain space but does not increase the number of combustion reactions taking place per unit of volume. In combination with the increase in the proportion of fuel thrown out of the flame, this leads very rapidly to an undesirable increase in the diameter of the flame, which brings with it the danger that the flame will touch the refractory lining of the combustion chamber and the fuel.

The object of the invention, therefore, is to create a method and a burner for burning solid, liquid or gaseous fuel, particularly for rotary kilns, in such a way that throwing out of fuel particles is avoided, rapid and uniform intermixing of the fuel-primary air free jet with the secondary air is achieved as well as an early start and rapid progress of the combustion and thus a short flame is achieved.

SUMMARY OF THE INVENTION

In the method, according to the invention, a proportion of the fuel is delivered together with primary air through the second annular duct and retarded to a speed of 5 to 20 m/s, preferably 7 to 10 m/s, in such a way that the ignition of this fuel branch stream takes place before it emerges from the burner. In this way the root of the principal flame is formed by a permanent pilot flame which is produced by this fuel branch stream. The quantities of fuel and air delivered to the permanent pilot flame can be regulated independently of the quantities of fuel and air delivered for the production of the principal flame.

According to the invention the fuel for the principal flame is delivered via the first, outer annular duct and thus surrounds the permanent pilot flame. This proportion of the fuel and the appertaining primary air are introduced into the combustion chamber at a very high speed of 70 to 120 m/s, preferably 80 to 100 m/s, which is possible because removal of the flame is prevented by the energy released in the combustion of the fuel branch stream in the root of the flame, i.e. in the permanent pilot flame. According to Bernoulli's law of flow the static pressure in the annular fuel jet falls proportionally to the square of the speed increase. If the speed of the fuel-air jet introduced into the combustion chamber through the first, outer annular duct is chosen so as to be sufficiently high, then this static pressure will be negative and the jet begins to draw in secondary air from the surroundings.

The geometry of the annular gap at the outlet end of the first, outer annular duct is chosen so that the emerging annular free jet has a wall thickness of approximately 5 to 20 mm, which depends upon the burner dimensions and the achievable manufacturing tolerances. The large outer surface area and the limited thickness of the annular jet simplify and favour the penetration and mixing in of the secondary air, as a result of which the combustion reaction begin very early and progress very rapidly.

The rate at which the secondary air mixes in and the progress of the combustion reactions can be controlled by means of the back pressure produced by the permanent pilot flame in the interior of the principal flame and by the quantity of heat introduced by the pilot flame.

The method according to the invention is also very suitable for the common burning of different fuels, for example pulverised coal and pyrolysis gas. The principal flame and the permanent pilot flame can each be produced from one of the fuel components.

By dividing the different fuel and air streams the method is also particularly good for the delivery of recirculated exhaust gases for the reduction of the $NO_x$ formation.

50 to 95%, preferably 70 to 85%, of the total fuel can be delivered through the first, outer annular duct which serves for production of the principal flame, whilst 5 to 50%, preferably 15 to 30%, of the total fuel is delivered through the second annular duct which serves for production of the permanent pilot flame.

The primary air delivered via the burner amounts advantageously to 5 to 30%, preferably 5 to 12%, of the total combustion air. The rest of the combustion air (secondary air) is not delivered via the burner.

In the conventional manner pipes (not shown) for delivery of fuel and/or primary air which are connected to the individual ducts of the burner are advantageously provided with regulating devices which serve to influence the quantities of fuel and/or air delivered.

THE DRAWINGS

One embodiment of a burner according to the invention is illustrated schematically in partial section in the drawing.

DETAILED DESCRIPTION

The illustrated burner contains a first, outer annular duct 1 which is provided at its outlet end with a narrowed cross-section in the form of a ring nozzle 1*a*.

Inside the first annular duct 1 a second annular duct 2 is arranged which is provided at the outlet end with a diffuser 2*a* which widens at an angle of approximately 7° and to which a precisely finished cylindrical end piece 2*b* is connected.

A third annular duct 3, which is provided at the outlet end with a swirler 3*a*, is arranged inside the second annular duct 2.

The third annular duct 3 surrounds a central duct 4. The ducts 1, 2, 3 and 4 are arranged coaxially with respect to the burner axis 5.

The proportion of the fuel which serves for production of the principal flame is delivered via the first annular duct 1 together with primary air and is accelerated by means of the ring nozzle 1*a* to a high speed of 70 to 120 m/s.

The proportion of the fuel which serves for production of the permanent pilot flame is delivered through the second annular duct 2 together with primary air and is retarded by means of the diffuser 2*a* to a low speed of 5 to 20 m/s. Therefore the combustion starts in the diffuser 2*a* or in the end piece 2*b*. The root of the principal flame is formed in this way by the permanent pilot flame.

Primary air is delivered through the third annular duct and is swirled by the swirler 3*a* as it escapes from this annular duct.

On starting, light-up fuel is delivered via the central duct 4 and burnt by means of the primary air delivered via the third annular duct.

The pipes connected to the ducts 1 to 4 for delivery of fuel and/or air and the regulating devices arranged in the pipes to influence the quantity of fuel or air are not illustrated in the drawing. It goes without saying that for example arrangements for dividing a fuel stream (e.g. dividing it between the ducts 1 and 2) can also be provided.

According to the invention the fuel is introduced into the combustion chamber via the annular ducts 1 and 2 in such a way that a free jet of fuel and primary air is produced which is completely or almost swirl-free. The flame produced by the outer annular duct 1 is stablised by the delivery of heat energy to the root of the flame, that is to say by producing a permanent pilot flame which starts immediately at the end of the burner.

The progress of the combustion reactions and thus the temperature profile are controlled by alteration of the internal heat supply and the static pressure in the free jet.

What is claimed is:

1. The method of controlling the burning of fuel in a rotary kiln and the like, said method comprising:

(a) defining a first annular combustion area for fuel mixed with primary combustion air;

(b) delivering the contents of said first annular combustion area to a kiln at a relatively high speed;

(c) defining a second annular combustion area within said first annular combustion area for fuel mixed with primary combustion air; and (d) delivering the contents of said second annular combustion area into said first annular combustion area at a relatively low speed, whereby said second annular combustion area functions as a permanent pilot to sustain and control the dimensions of said first annular combustion area.

2. The method of claim 1 wherein the speed of delivery of the contents of said first combustion area is within the range of 70 to 120 m/s, and the speed of delivery of the contents of said second combustion area is within the range of 5 to 20 m/s.

3. The method of claim 1 wherein the speed of delivery of the contents of said first combustion area is within the range of 80 to 100 m/s, and the speed of delivery of the contents of said second combustion area is within the range of 7 to 10 m/s.

4. The method of claim 1 wherein said first combustion area delivers 50 to 95% of the total fuel utilized, and said second combustion area delivers 5 to 50% of the total fuel utilized.

5. The method of claim 1 wherein said first combustion area delivers 70 to 85% of the total fuel utilized, and said second combustion area delivers 15 to 30% of the total fuel utilized.

6. The method of claim 1 wherein the amount of primary combustion air utilized is 5 to 30% of total combustion air.

7. The method of claim 1 wherein the amount of primary combustion air utilized is 5 to 12% of total combustion air.

8. The method of claim 1 wherein further primary combustion air is delivered within said second combustion area and separately therefrom.

9. The method of claim 1 wherein further fuel is delivered centrally of said combustion areas for ignition of said contents of said combustion areas.

10. The method of claim 2 wherein said first combustion area delivers 50 to 95% of the total fuel utilized, the second combustion area delivers 5 to 50% of the total fuel utilized, and the amount of primary combustion air utilized is 5 to 30% of total combustion air.

11. The method of claim 1 wherein said first combustion area delivers 70 to 85% of the total fuel utilized, said second combustion area delivers 15 to 30% of the total fuel utilized, and the amount of primary combustion air utilized is 5 to 12% of total combustion air.

12. A burner for burning solid, liquid, or gaseous fuel and particularly adapted for use in a rotary kiln and the like, said burner comprising:

a first outer annular duct for defining a first annular combustion area for a first mixture of fuel and primary air, said first duct having a discharge end of outwardly narrowing cross-section whereby said first mixture is discharged at a relatively high velocity; and a second annular duct for defining a second annular combustion area for a second mixture of fuel and primary air, said second duct being positioned within said first duct and encircled thereby, said second duct having a discharge end of outwardly widening, diffusing cross-section whereby said second mixture is discharged at a relatively low velocity, the discharge end of said second cut being so positioned relative to the discharge end of said first duct as to provide a permanent pilot at the root of said first combustion area to sustain and control the dimensions of said first combustion area.

13. The burner of claim 12 including a third annular duct within said second annular duct and encircled thereby, said third annular duct being operable to supply primary air and having a swirler at its discharge end, whereby primary air leaving said third annular duct has a swirling motion imparted thereto.

14. The burner of claim 13 including a fourth duct centrally of said other ducts and encircled thereby, said fourth duct being operable to supply fuel.

* * * * *

UNITED STATES PATENT AND TRADEMARK OFFICE

CERTIFICATE OF CORRECTION

PATENT NO. : 4,846,666

DATED : July 11, 1989

INVENTOR(S) : Hans Bilawa and Eberhard Neumann

It is certified that error appears in the above-identified patent and that said Letters Patent is hereby corrected as shown below:

Column 4, line 57, change "cut" to -- duct --.

Signed and Sealed this

Twenty-fourth Day of April, 1990

*Attest:*

HARRY F. MANBECK, JR.

*Attesting Officer*

*Commissioner of Patents and Trademarks*